US006478179B1

(12) United States Patent
Alexander

(10) Patent No.: US 6,478,179 B1
(45) Date of Patent: Nov. 12, 2002

(54) RESEALABLE CAP FOR CARBONATED BEVERAGE CAN

(75) Inventor: Tony M. Alexander, Six Mile, SC (US)

(73) Assignee: Ken L. Alexander, Aubrey, TX (US)

( * ) Notice: Subject to any disclaimer, the term of this patent is extended or adjusted under 35 U.S.C. 154(b) by 0 days.

(21) Appl. No.: 09/927,157

(22) Filed: Aug. 10, 2001

(51) Int. Cl.[7] ..... B65D 45/16

(52) U.S. Cl. ..... 220/325; 220/708; 220/714; 222/183; 222/484

(58) Field of Search ..... 220/325, 324, 220/708, 709, 714; 222/131, 183, 536, 484

(56) References Cited

U.S. PATENT DOCUMENTS

| | | | | |
|---|---|---|---|---|
| 4,429,804 A | | 2/1984 | Pease | 220/247 |
| 4,804,103 A | | 2/1989 | Goldberg | 220/251 |
| 5,065,909 A | | 11/1991 | Pino et al. | 222/484 |
| 5,105,964 A | | 4/1992 | Heath | 220/254 |
| 5,110,002 A | | 5/1992 | Tucker | 220/254 |
| 5,203,467 A | | 4/1993 | Tucker | 220/254 |
| 5,242,079 A | | 9/1993 | Stephens et al. | 220/705 |
| 5,273,172 A | * | 12/1993 | Rossbach et al. | 220/708 |
| 5,402,904 A | | 4/1995 | Close | 220/254 |
| 5,415,312 A | | 5/1995 | Mueller | 220/254 |
| 5,452,818 A | | 9/1995 | Yost | 220/258 |
| 5,467,888 A | | 11/1995 | Brandstrom et al. | 220/319 |
| 5,477,994 A | | 12/1995 | Feer et al. | 222/484 |
| 5,501,357 A | * | 3/1996 | Fullin | 220/325 |
| 5,873,478 A | | 2/1999 | Sullivan et al. | 215/389 |
| 6,053,347 A | | 4/2000 | Fullin | 220/246 |
| 6,073,797 A | | 6/2000 | Barous | 220/716 |
| 6,116,458 A | | 9/2000 | Dark | 220/709 |
| 6,155,452 A | | 12/2000 | Laurent | 220/739 |

* cited by examiner

*Primary Examiner*—Philippe Derakshani
(74) *Attorney, Agent, or Firm*—J. Herbert O'Toole; Nexsen Pruet Jacobs & Pollard, LLC

(57) ABSTRACT

A device for sealing an open beverage can employs a cap and clamping jaws articulated from the cap which lock into the top lid of the can to push the can into secure contact with the cap. The cap may include a turret and straw for drinking from the can without removing the cap. Insulating sleeves to keep the beverage cold may be part of the cap.

4 Claims, 9 Drawing Sheets

RESEALABLE CAP FOR CARBONATED BEVERAGE CAN

BACKGROUND OF THE INVENTION

1. Field of the Invention

The invention is directed to devices for resealing containers of carbonated beverages and, optionally, retarding their warming.

2. Background in Prior Art

Carbonated beverages are extremely popular worldwide and the containers in which they are provided have become standardized. A typical can holds 355 ml (12 fl.oz.), has as a top with a diameter of approximately 550 mm and includes a depressed area having a frangible region adjacent a "pop top" lever which opens the can by pushing the frangible section into the can. Opening releases some of the carbon dioxide dissolved in the beverage and allows the liquid to be poured into a container or, alternatively, the beverage may be drunk directly from the container or through a straw.

A persistent problem when the cans contain soda pop and the consumers are pre-adolescent children is that, before the contents are consumed, the can is either spilled or the carbonation is lost. When the product is spilled it cannot be drunk and when the product loses carbonation, typically with attendant warming, it will not be drunk. As a result, there is a need for a simple, convenient, and inexpensive device which allows a conventional can of carbonated beverage to be resealed for further use, which is spill-proof but still allows the product to be accessible and which is economically effective.

Numerous attempts have been made to address this problem. U.S. Pat. No. 4,429,804 to Pease discloses a beverage can resealer which uses a cam-actuated foot inserted through the pouring hole to hold a covering body over the top. U.S. Pat. No. 4,804,103 to Goldberg employs a cam-locked lever also utilizing a component which presses against the undersurface of the can lid. Both of the above-mentioned references require that the sealing apparatus be removed before beverage can be removed from the container.

U.S. Pat. No. 5,065,909 to Pino et al. discloses a snap-on cap to be pressed over the top of a beverage can and includes a straw and a tubular lever with a valve at its base which allows someone to draw liquid through the straw when the lever is in the open position. U.S. Pat. No. 5,105,964 to Heath discloses a snap-on cap for a beverage can which serves to reseal the container but which must be removed before the contents may be poured. U.S. Pat. No. 5,110,002 to Tucker discloses a snap-on cap fitted with a separate cover which may be located over the opening in the top of the can and includes a screen to keep out flying insects, especially bees. U.S. Pat. No. 5,203,467 to Tucker discloses a variant of the above having a different snapping arrangement to retain the cover.

U.S. Pat. No. 5,242,079 to Stephens et al. discloses a spout and straw similar to U.S. Pat. No. 5,065,909 to Pino et al. improved by the presence of a vent which is opened with the rotating spout to prevent spurting of the beverage due to pressure increases in the can on warming. U.S. Pat. No. 5,402,904 to Close discloses a variant of the Tucker patents which snaps onto the top surface of the can.

U.S. Pat. No. 5,452,818 to Youst discloses a one-piece snap-on cover without vent holes, similar to the Heath '964 patent. U.S. Pat. No. 5,467,888 to Brandstrom et al. discloses a conical cover and spout similar in appearance to a inverted funnel which is held in place using a separate annular ring. U.S. Pat. No. 5,873,478 to Sullivan et al. discloses a sealing cap, preferably for a bottle having screw threads and including a levered spout and a valving system to prevent squirting of the carbonated beverage when the spout is opened. U.S. Pat. No. 6,039,207 to Adamek discloses an insulating cylinder into which a beverage can is inserted and a hinged cap which seals the container. U.S. Pat. No. 6,053,347 to Fullin discloses a cover seal for a can of carbonated beverages which includes four fingers which engage the outside of the top of the beverage can and which are pulled into place using a cam and lever system. The cover must be removed before the contents can be poured or drunk. U.S. Pat. No. 6,073,797 to Barous discloses a snap-on cover for a can having a sliding top which opens and closes the orifice. U.S. Pat. No. 6,116,458 to Dark discloses a flexible straw ending in a pivoted drinking spout primarily designed to attach to a cup. U.S. Pat. No. 6,155,452 to Lurent discloses a seal for a beverage can which includes a cup or insulating sleeve directly engageable to the can.

The number of attempts to affix a cap to an open beverage can which allows access without removing the cap and while providing secure affixation attest to the difficulty of the task at hand.

BRIEF SUMMARY OF THE INVENTION

It is an object of the invention to provide a sealing cap for a beverage can which locks securely in place to maintain carbonation of the contents. It is further object of this invention to provide a cover which allows access to the contents through a straw and a flip-up spout. It is a further object of this invention to provide a seal and drinking spout for a beverage can. It is a still further object to provide a sealing cap which incorporates means for insulating the container from the heat.

These and other objectives maybe achieved by providing a sealing cap having at least one clamping member articulated from the cover which may be locked in place by engaging the outer rim of the lid of the beverage can. Mechanical locking systems useful in accordance with this invention include cam and lever arrangements, eccentric ramps and screw chucks or slip nuts.

DETAILED DESCRIPTION OF THE INVENTION

The sealing cap of this invention employs clamping jaws which grasp tightly a beverage can at the end (top) which carries the frangible opening, typically a "pull-tab" opening. Beverage cans, especially those designed to contain 355 ml, are formed from two pieces of aluminum. The can is formed as a closed cylinder from a single stamping and a cover plate including the opening device is attached as a type of end plate or cap. To effect a good seal, the covering plate is crimped around the end of the first cylindrical portion. The circumferential region at the crimp area becomes the strongest part of the container because it is three layers in effective thickness. In most configurations currently in use there exists a small lip where the covering plate ends.

This invention takes advantage of the lip and the inherent strength of the can at that region to effect a good seal by drawing down a sealing cap using jaws to engage the can at the lip. The sealing cap is substantially circular and may bear a gasket around the edge which engages with the lip of the beverage container. The clamping jaws are forced radially inwardly at one or more locations and locked in place by a variety of means to be discussed below. The jaws are articulated so as to lift as they move inwardly so as to draw the can into the sealing cap.

The invention may also be used with PET plastic bottles with similarly sized mouths, such as are used for some "sport drinks."

Figure 1:
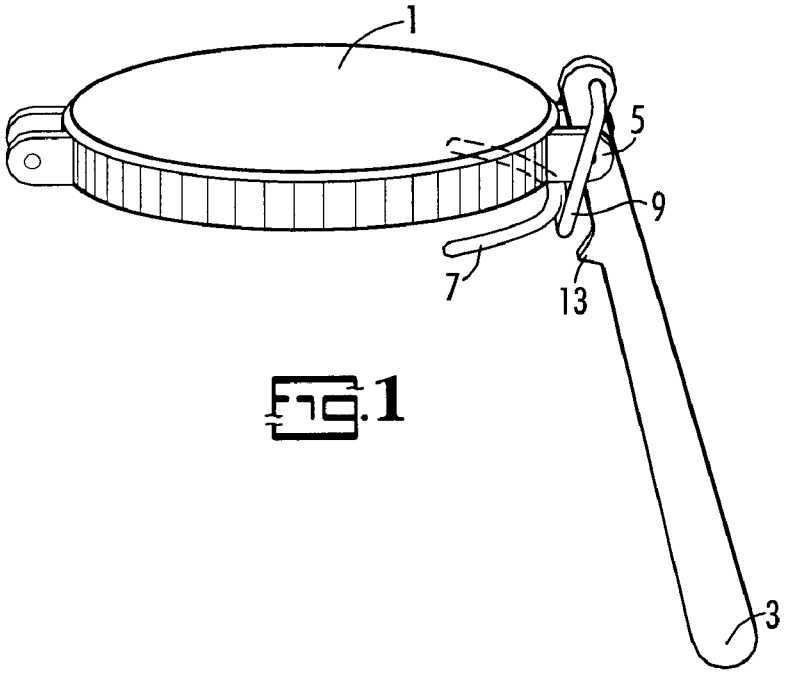
FIG. 1 illustrates a first embodiment of the invention which employs a hinge pin in a sealing cap and external lever.

As shown in FIG. 1 a sealing cap 1 carries at least one lever 3 attached through hingepin 5 and articulated to thrust clamping jaw 7 radially inward toward the can. In the embodiment shown in FIG. 1, the clamping jaw is actuated by a combination of secondary lever 9 hinged to lever 3 and secured in place by an engaging foot 13 protruding from lever 3.

Figure 2:
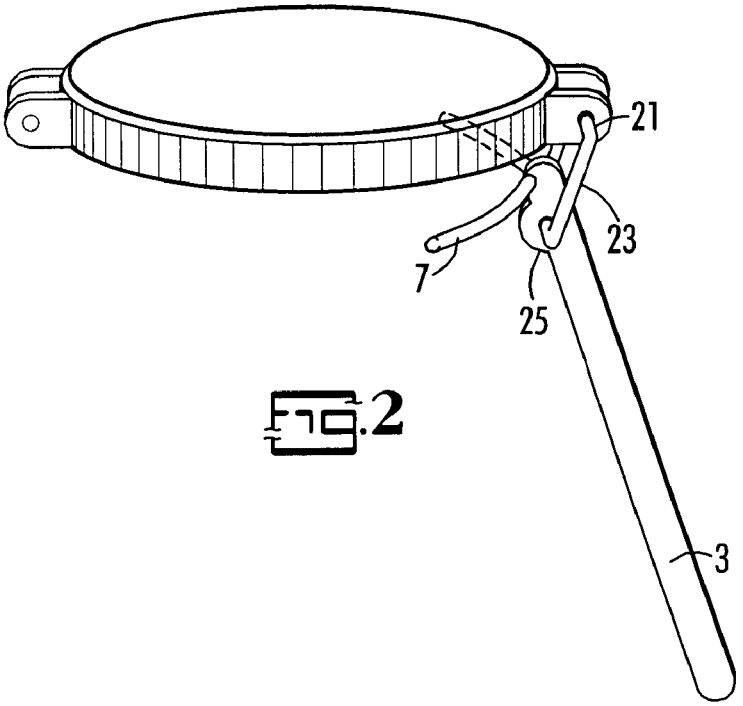
FIG. 2 illustrates a second embodiment of the invention using a suspensory link to locate a lever and clamping jaw.

FIG. 2 illustrates an alternative embodiment wherein the lever 3 carries clamping jaw 7 as an extension of the lever and the combination is held in place by a suspensory lever 23 hinged to the sealing cap 1 by hingepin 21 and to the lever by an articulation effecting a hinge at 25. In FIGS. 1 and 2, only one combination lever and securing jaw have been illustrated. The invention may entail multiple combinations of levers to secure the device in place.

Figure 3A:
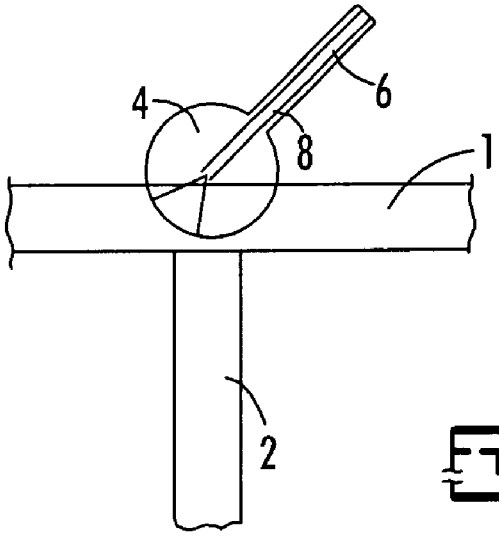
FIGS. 3A and 3B illustrate a straw attached to a sealing cap.
Figure 3B:
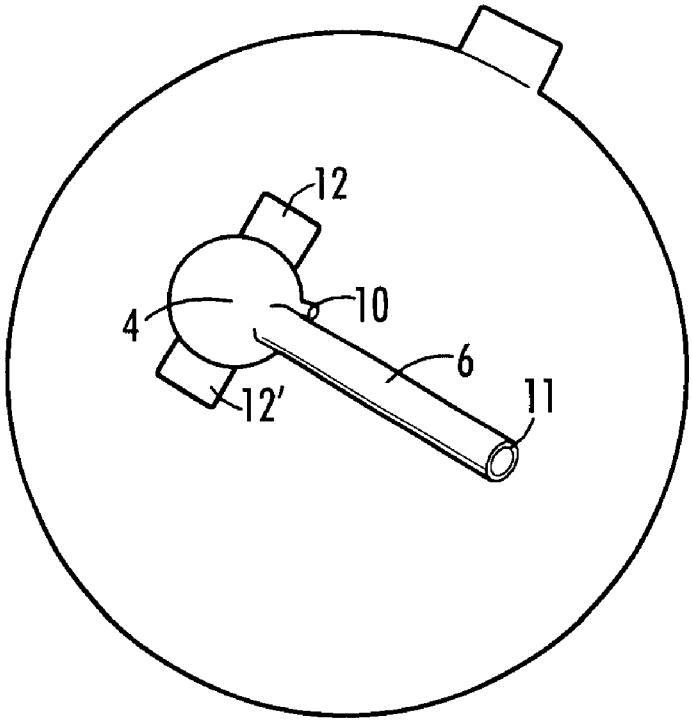

The device illustrated in FIGS. 1 and 2 may serve merely as a cap to maintain carbonation pressure and prevent spills. In a preferred embodiment the sealing cap would incorporate a straw descending into the beverage container and a flip-up tubular spout to which liquid may be drawn. FIG. 3*a* is a side elevation of a suitable straw arrangement. Straw 2 extends below cap 1. The straw may be integral with cap 1 or attach by insertion into a bore hole (not shown) or slid around a small tubular extension (not shown). A turret 4 having a projection 6 is hingeably rotated in or above cap 1. As shown in FIG. 3*b*. the turret may be mounted on cap 1 using attaching points 12, 12'. The attaching points provide hinging points to allow the turret to be snap-fitted onto the cap using hinge pin extensions from the turret, nibs on the turret or stub hinges or by other means which allow disassembly for cleaning. A bore 8 passes through projection 6 into the turret and provides communication to straw 2 when rotated. When connection is established, projection 6 becomes a straw and the liquid in the beverage container may be drawn out through opening 11. A second opening 10 which may connect to bore 8 but preferably is vented under cap 1 serves to provide a pressure release when projection 6 is first raised and also allows make-up air to enter the container. Second opening 10 preferably opens before the straw bore 8 is opened.

When the flip-up straw as described above is used, the cap may be left in place and the contents withdrawn over a period of time without fear of spillage or loss of carbonation. The device is particularly useful when it is preferred to put the beverage can back into a refrigerator or cooler.

Figure 4:
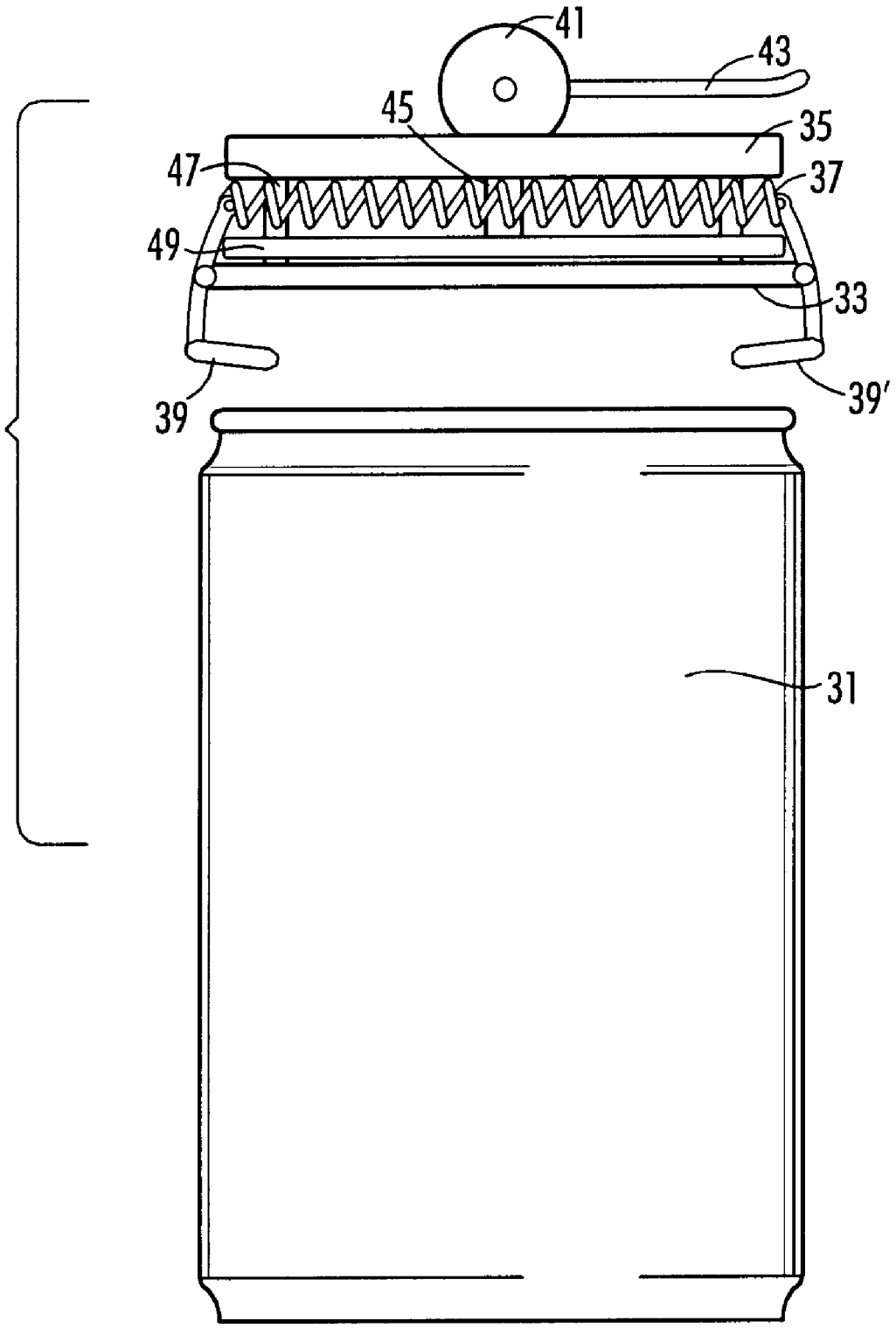
FIG. 4 illustrates a seal using a cam actuation from the top.

FIG. 4 illustrates an alternative embodiment for actuation of the clamping jaws. As illustrated in FIG. 4, atop a beverage can 31 is placed a device which consists of a sealing cap 33 which engages the lip of the can 31. At least 2 clamping jaws 39, 39' are pivoted on the sealing cap for engagement with the lip of the can. A cover plate 35 may be supported a distance from sealing cap 33 by stilts 47. A cam-lock 41 having a lever 43 is connected to a pull rod 45 which draws up a disk plate 49 which engages the upper end of clamping jaws 39, 39' and causes the lower end to project inwardly and upwardly grasping the can. When the cam-lock is released a spring 47 acts to urge the clamping jaws 39, 39' outwardly. This embodiment is preferredly a sealing arrangement and is not suitable for use with a flip-up straw.

Figure 5:
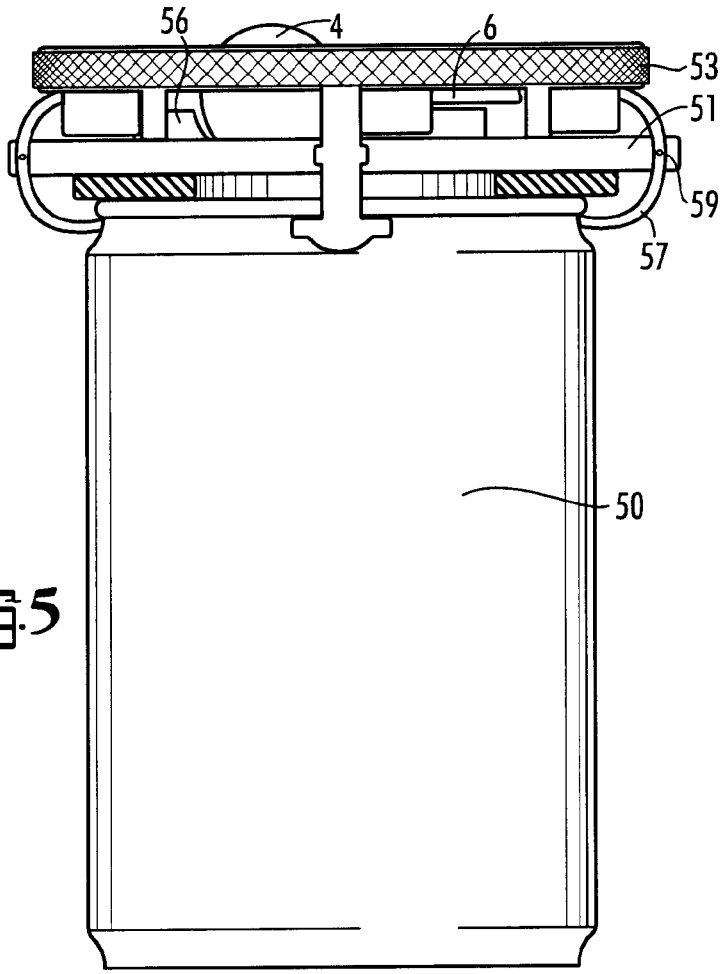
FIG. 5 illustrates an embodiment of the invention wherein the lock is affected by twisting a slip nut.
Figure 6:
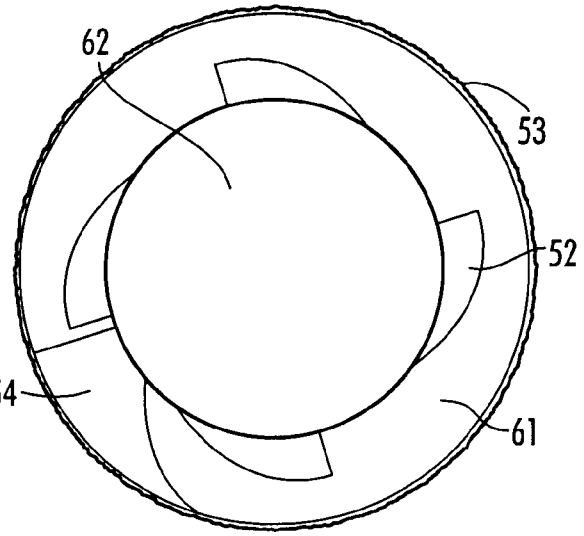
FIG. 6 is a detail of the locking clamp of FIG. 5.

FIGS. 5 and 6 illustrate another embodiment employs a slip nut to clamp to the beverage can. A seal cap 51 is placed on a beverage can 50. The seal cap 51 carries clamping jaws 57 which are articulated at hinges 59 and an upper portion thereof and engages locking slip nut 53. As seen from FIG. 6 the knob has expanding ramps 52 which would be integral with the knob 53 and which form an arch so that upon engagement of the top end of jaw 57 the top is rotated radially outward from the center line of the seal cap and the jaws are moved radially inward and upwardly to engage the top of can 50. A step 61 at the end of the ramp provides a space whereby the clasping jaws may be held in the early disengaged position. The center 62 of the slip nut 53 is open to allow passes of the straw.

As shown in FIG. 5, a valve mechanism 4 and a flip-up straw 6 may be used with this configuration and may incorporate a straw extending from the seal cap as shown in FIG. 3*a* into the beverage can. It is preferred that the outer surface of seal cap 51 and clamp knob 53 have a serrated or knurled edge. At least one retainer 56 projecting upwardly from seal cap 51 cages the slip nut 53 to prevent separation. A second ramp and stop landing B54B optionally may be used to push the jaws out when releasing the can and to prevent the jaws being released by over tightening.

Figure 7A:
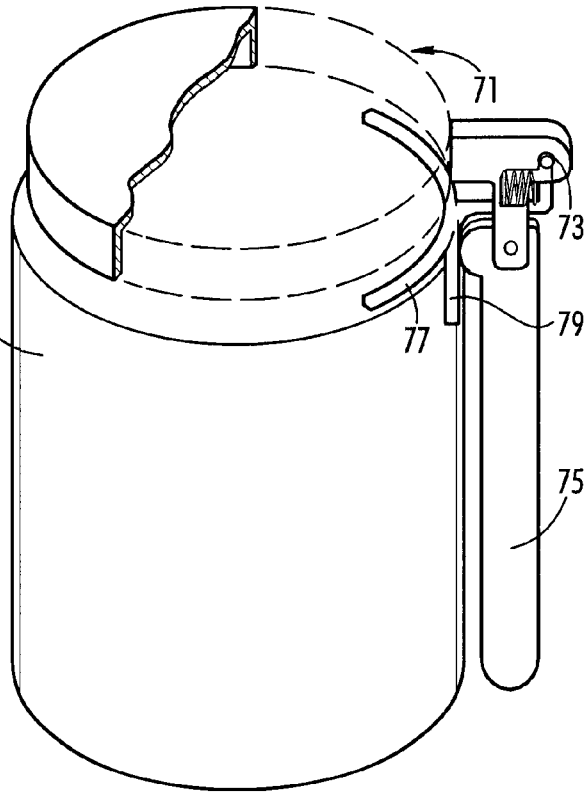
FIGS. 7A and 7B are embodiments of the invention using a cam lever and a floating hinge.

FIG. 7A illustrates an alternative embodiment when the seal cap 71 is placed on beverage can 70. Lever 75 acting through hinge 73 forces clamping jaw 77 into engagement with the beverage can and to pull the can into contact with the seal. In this embodiment this clamping jaw is floated from a hinge in the sealing cap and pressure is applied to an actuating arm 79.

Figure 7B:
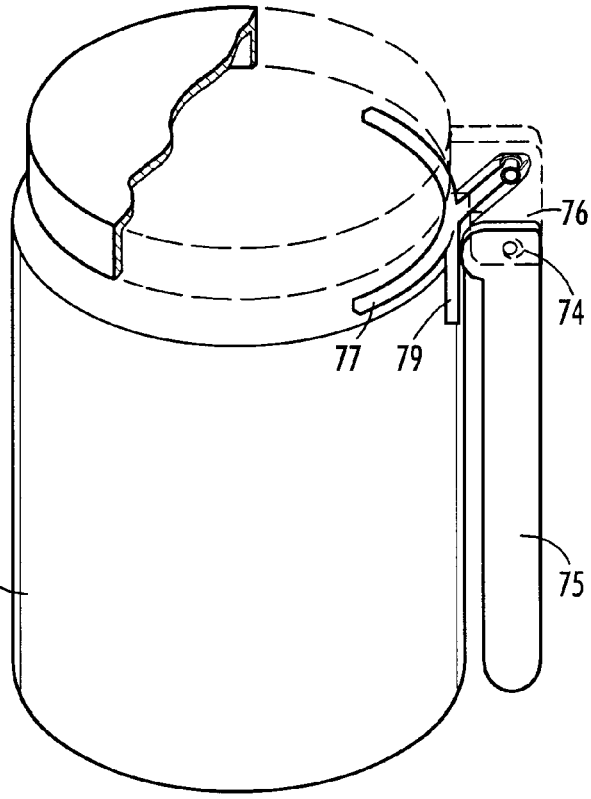

A variation of the arrangement shown in FIG. 7A is that shown in FIG. 7B. In this embodiment, the hinge 74 connects cap 71 and lever 75 using ears 76 to create a fulcrum point and the jaw 77 is articulated using a channel instead of hinge 73. As shown, this embodiment may use one lever 75, the circumference of the sealing cap providing a surface against which the can is forced. Multiple levers may also be used. A turret and straw such as shown in FIG. 3A and FIG. 3B may be a part of seal cap 71.

Figure 8:
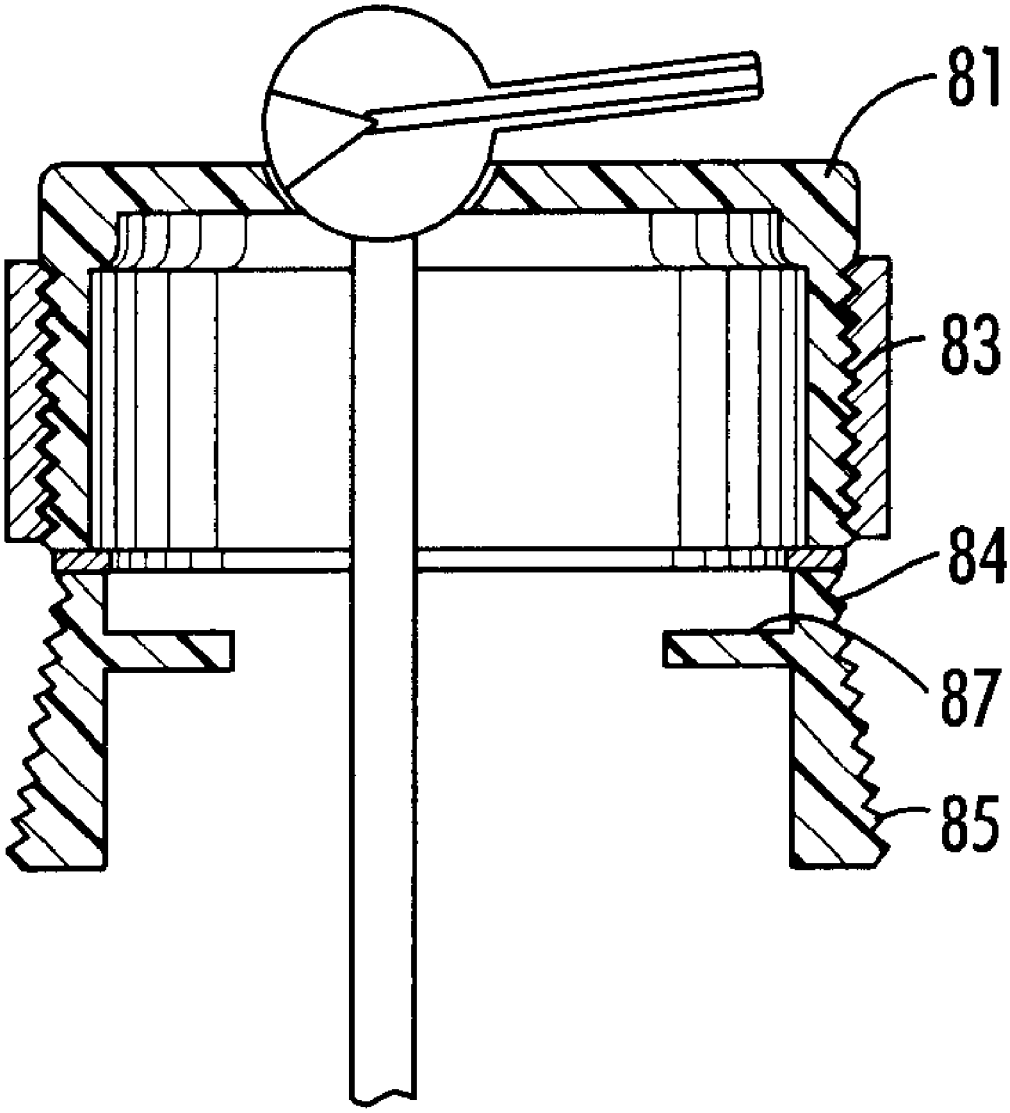
FIG. 8 is illustrates an embodiment of the invention employing a cap and slip nut.

FIG. 8 illustrates an additional embodiment wherein threaded sleeve or slip nut 83 may be twisted about sealing cap 81 but behind the sleeve. As the sleeve is screwed down projecting arms 85 having fretted sides 84 are compressed inwardly to engage the locking jaws 87 into the sides of the beverage can. A smaller version of this embodiment may be used with a plastic bottle.

Figure 9A:
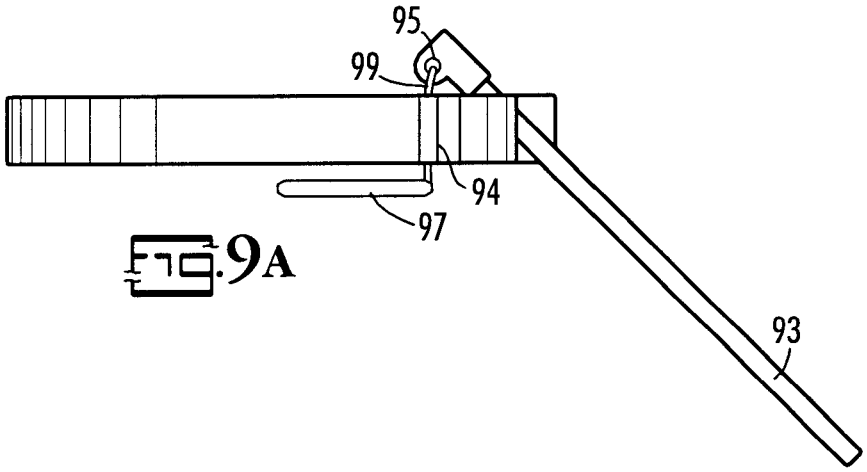
FIGS. 9*a*, 9*b* and 9*c* illustrate an embodiment of the invention using a pull rod.
Figure 9B:
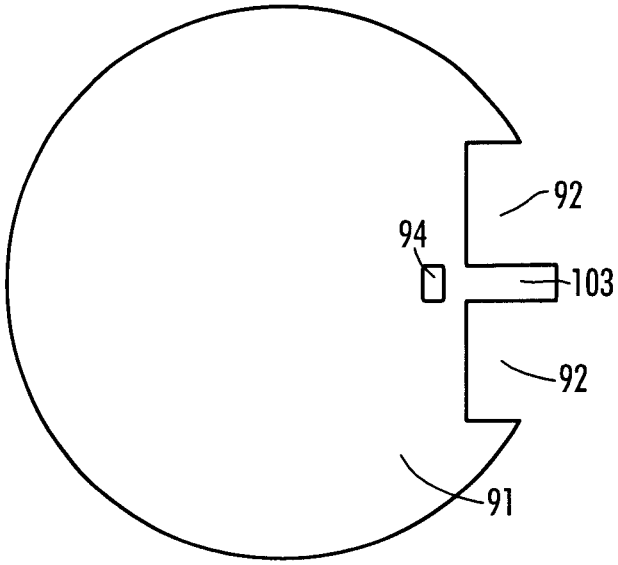
Figure 9C:
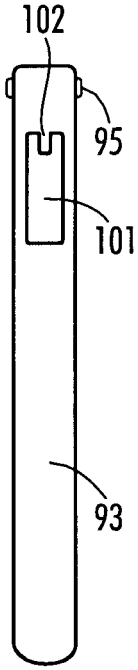

FIGS. 9A, 9B and 9C show another embodiment in which the lever 93 engages in slots 92 in sealing cap 91 and the clamping jaws 97 are actuated by a hinge 95 and link lever 99 which pass through a hole in the sealing cap 94. FIG. 9A illustrates and alternative embodiment. As shown especially in FIG. 9A, a locking step 101 on the side of lever 93 (the side facing the beverage can) having a beveled notch 102 engages the projection 103 from sealing cap 91 to provide a locking action on clamping jaws 97 to hold the sealing cap in position. A turret such as shown in FIG. 3A and FIG. 3B may be attached to sealing cap 91.

Figure 10:
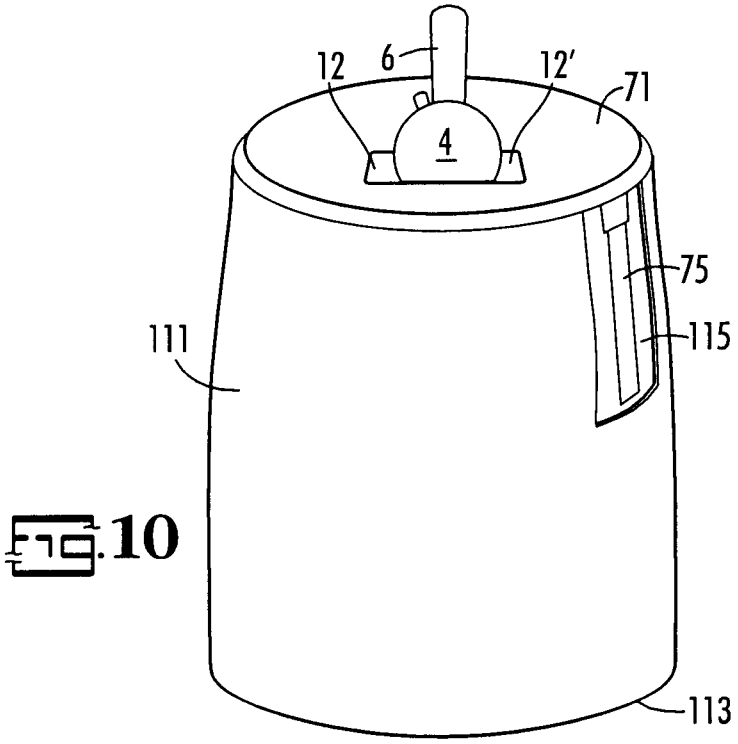
FIG. 10 illustrates an embodiment incorporating a straw and a insulating sleeve.

FIG. 10 illustrates the use of the cap of this invention together with an insulating sleeve. Sealing cap 71, together with locking lever 75 are secured to an insulating sleeve 111, leaving opening 113 for insertion of a beverage can. A voided area 115 in sleeve 111 allows closure of lever 75 to effect locking of the beverage can to sealing cap 71 which is then fittingly secured within the sleeve.

Figure 11:
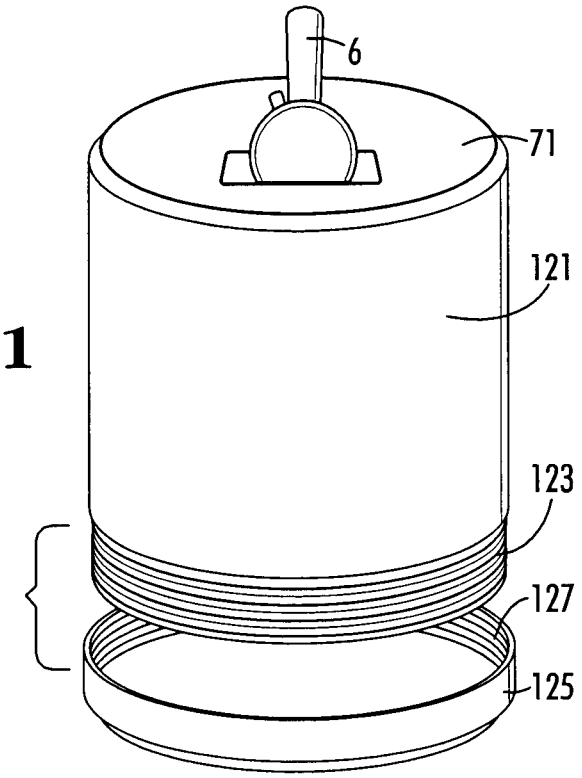
FIG. 11 is an alternative embodiment having an insulated sleeve.

FIG. 11 shows an alternative which is a second embodiment of a sealing cap with insulating sleeve. In this embodiment, sealing cap 71 is formed integrally with a rigid insulating sleeve 121. At the bottom of insulating sleeve 121 or has external threads 123. A cap 125 having internal threads 127 is engaged with the insulating sleeve 121 to lock the beverage container into engagement with sealing cap 71. A straw arrangement 6 as shown in FIGS. 3A and 3B may be incorporated. Optionally, a handle may be formed with or attached to the insulating sleeve 121.

Figure 12:
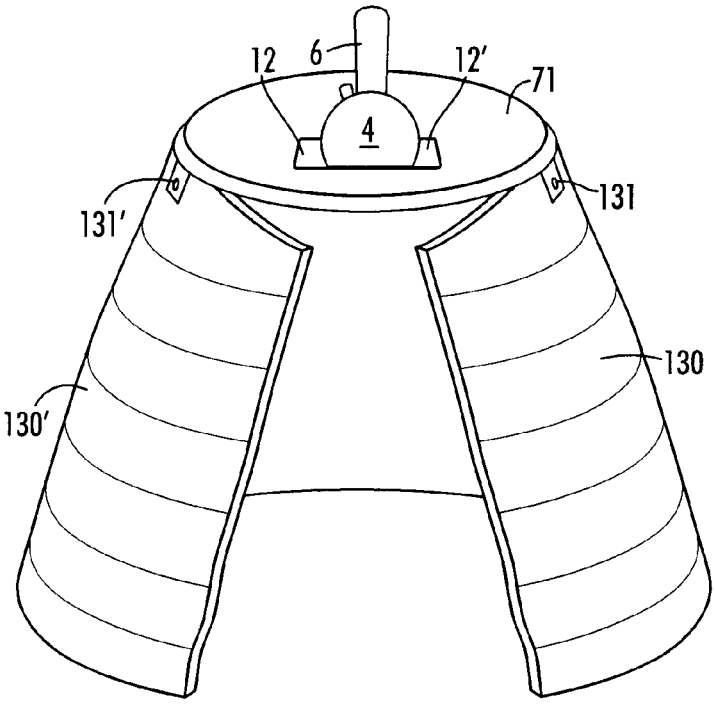
FIG. 12 is a third embodiment of the invention having an insulating sleeve integral with a locking lever.

FIG. 12 illustrates a combination of sealing cap and insulating sleeve in which the lever and insulator are combined. The clamshell has a sealing cap 71, turret 4, straw 6, hinges 12, 12'. Levers as illustrated in any one of FIGS. 1,2,7A,7B,9A,9B and 9C are integrated with an insulating half shell 130, 130' hinged to cap 71 at 131, 131'.

Figure 13:
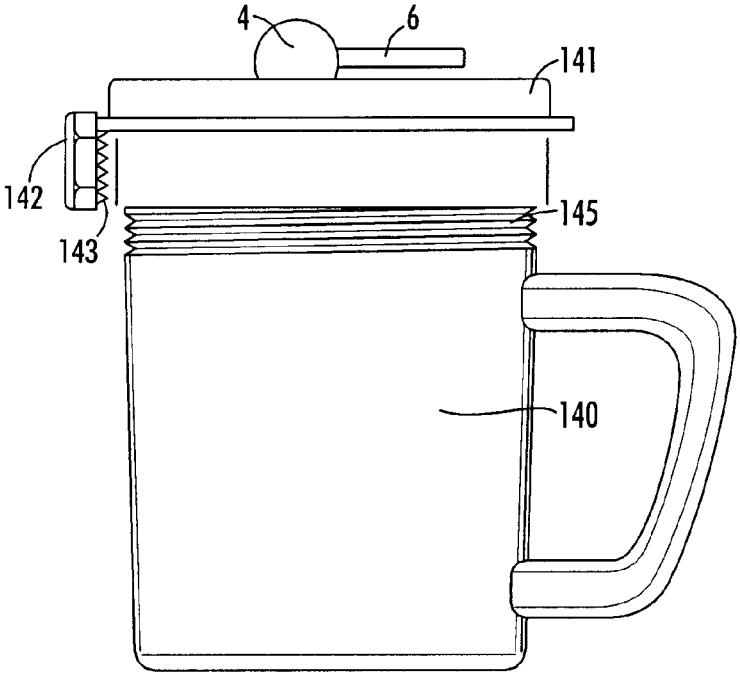
FIG. 13 is a fourth embodiment having an insulating sleeve and a sealing cap held together by a slip nut.

FIG. 13 illustrates another embodiment of the invention. An insulated cup 140 accepts a beverage can and sealing cap 141 with turret 4, and straw 6 is pressed onto the cup by means of a slip nut 142 having threads 143 which engage threads 145 on the cup 140.

The materials used in this invention are selected on the basis of strength, formability, cost and heat conduction. Metals such as aluminum and mild steel may be used for the cap, levers and especially levers such as secondary lever 9. Metals, however, are good heat sinks and not preferred. The sealing cap is preferably made from plastic, as are the turret and projection straw 6 for cost and heat insulation. For reasons of cost, levers are preferably made from plastic. Insulating sleeve III is preferably a foamed plastic. Hard sleeve 121 or 130 is preferably polyethylene, HDPE or any appropriate engineering plastic material such as polypropylene (HDPP). Injection molding is the preferred method of fabrication. Locking levers may be made from aluminum, mild steel, stainless steel 300 series or engineering plastics. The seal between cap and can should be formed from a washable rubber and is preferably attached securely to the sealing cap by water resistant adhesive or electronically. All components must be "dishwasher safe" and the turret should be dismountable for separate cleaning.

The invention has been described in terms of representative embodiments for illustrative purposes. Variations in detail which do not deviate from the concept of the invention are encompassed by the scope of the invention which is defined more particularly by the claims.

I claim:

1. A device for the sealing of an open beverage container comprising:

a sealing cap;

a gasket on said cap disposed toward a lip of a cylindrical beverage container;

a locking mechanism securing said sealing cap to said beverage container;

a locking mechanism comprising at least one clamping-jaw engaging at least a portion of the circumferential surface of an upper portion of said cylindrical beverage container, said at least one clampingjaw being urged into contact with said circumferential surface of an upper portion of said beverage container by a slip knot having a beveled ramp on a surface thereof.

2. A device according to claim 1 further comprising a straw projecting from a turret which acts as a valve when turned.

3. A device according to claim 2 further comprising a relief valve integrated into said turret.

4. A device according to claim 2 further comprising an insulating sleeve around at least the circumferential surface of said cylindrical beverage container.

* * * * *